United States Patent [19]

Rushing et al.

[11] Patent Number: 4,842,284

[45] Date of Patent: Jun. 27, 1989

[54] CENTER SOCCER TWO WAY GOAL

[76] Inventors: James L. Rushing; John L. Rushing, both of 577 S. Coast Hwy., Laguna Beach, Calif. 92652

[21] Appl. No.: 245,949

[22] Filed: Sep. 16, 1988

Related U.S. Application Data

[63] Continuation of Ser. No. 937,745, Dec. 4, 1986, abandoned.

[51] Int. Cl.[4] ..... F41J 1/10

[52] U.S. Cl. ..... 273/395; 273/26 A; 273/411; 273/407

[58] Field of Search ..... 273/55 D, 410, 411, 273/407, 400, 127 R, 127 B, 401, 402, 126 A, 181 F, 1.5 R, 118 R, 26 A, 26 R; 135/118; 248/156

[56] References Cited

U.S. PATENT DOCUMENTS

| | | | |
|---|---|---|---|
| 2,898,924 | 8/1959 | Gesser | 135/118 |
| 3,013,801 | 12/1961 | Kirkconnell | 273/26 A |
| 3,814,118 | 6/1974 | Larson | 135/118 |
| 3,865,375 | 2/1975 | Cosgrove | 273/118 R |
| 3,908,992 | 9/1975 | Cunningham et al. | 273/55 D |
| 4,234,235 | 12/1980 | Torres | 273/395 |
| 4,420,158 | 12/1983 | Klock et al. | 273/400 |
| 4,482,157 | 11/1984 | McNeil | 273/411 |
| 4,650,189 | 3/1987 | Rajacich | 273/26 A |
| 4,702,478 | 10/1987 | Kruse | 273/410 |
| 4,718,668 | 1/1988 | Schipske | 273/26 A |

FOREIGN PATENT DOCUMENTS

| | | | |
|---|---|---|---|
| 2227882 | 11/1974 | France | 273/411 |

*Primary Examiner*—Edward M. Coven
*Assistant Examiner*—Mark J. Graham
*Attorney, Agent, or Firm*—Stetina and Brunda

[57] ABSTRACT

A two way soccer goal is disclosed which includes a framework holding a net within it. The goal is joined together in such a way as to allow the framework and net to remain joined even as the goal is disassembled for storage or transporting. The end posts of the framework are open at the bottom ends, thus allowing them to be placed over the two stakes placed into the ground. The two way feature allows the game to be played in a small area by placing the goal in the center of the playing area. One side is the goal of one team, and the opposite side is the goal of the opposing team.

7 Claims, 1 Drawing Sheet

CENTER SOCCER TWO WAY GOAL

This is a continuation of co-pending application Ser. No. 937,745 filed on Dec. 4, 1986, now abandoned.

FIELD OF THE INVENTION

This invention relates to devices useful to play the game of soccer, and, more particularly, to the construction of a collapsible goal for placement on the playing field.

BACKGROUND OF THE INVENTION

The game of soccer is played upon a field approximately 91 to 118 meters long by 45.5 to 91 meters wide, marked with goal-lines, touch-lines and dividing lines. The ball used is spherical and between 68.5 and 71 centimeters in circumference. The goal posts are set in the middle of the goal line and are 7.2 meters apart with a crossbar 2.4 meters from the ground. The ball must pass underneath the crossbar between the posts in order to score, and each goal scored counts as one point. Eleven players make up each team.

Soccer goals are constructed of side posts, cross bars on top extending between side posts, and a net attached from side to side and top to bottom. Such goals are typically 5.4 meters to 7.2 meters wide and 1.8 meters to 2.4 meters high. The net is attached on sides and top bar and stretched away from the field side and staked to the ground forming a cavity into which the game ball is kicked for a score. A goal is typically placed one at each end of the field. Contemporary goals are one way goals, i.e. allowing a score from only one side.

An important object of the invention is to provide a means of using a single goal for both teams with the goal located in the center of the playing area.

Another object of the invention is to provide a means of bringing the game of soccer to the domestic yard and other smaller areas by a single goal placed in the center of the playing area such that opposing teams move the ball into their designated side for a score.

Yet another object of the invention is to provide a soccer goal that is collapsible, highly portable, and so is easily set up in areas of play, and then removed to be stored away for the next game.

Another object of the invention is to provide a soccer training and practice aid as it can be utilized by an individual kicking into the net from various distances and angles.

Additional objects and advantages of the invention will become apparent as the following detailed description of a preferred embodiment of the invention is read in conjunction with the accompanying drawings which illustrate a preferred embodiment of the invention.

GENERAL DESCRIPTION OF THE DRAWINGS

FIG. 1 is a front view of the presently preferred embodiment of the invention.

DETAILED DESCRIPTION OF THE PRESENTLY PREFERRED Embodiment of the Invention

Figure 1:
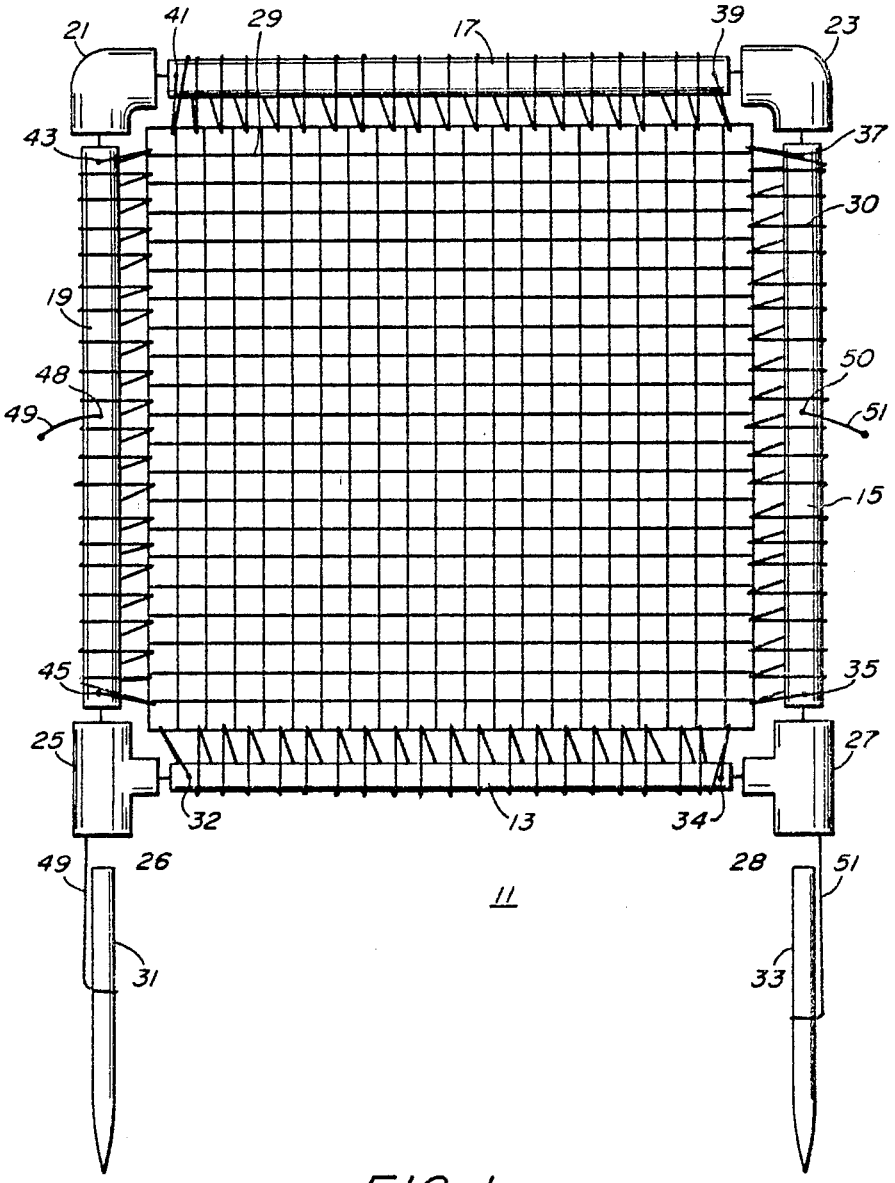

The detailed description set forth below in connection with the appended drawings is intended merely as a description of the presently preferred embodiment of the invention, and is not intended to represent the only form in which the present invention may be constructed or utilized. The description sets forth the structure in connection with the illustrated embodiments. It is to be understood, however, that the same or similar structures are intended to be encompassed within the spirit and scope of the invention.

Referring to FIG. 1, the presently preferred embodiment of the invention is illustrated. The structure generally includes a framework 11 formed of straight members such as tubes 13, 15, 17, 19, elbows 21 and 23, and "T" connectors 25 and 27. "T" connectors 25 and 27 are formed to receive stakes 31 and 33, which are designed to be placed into the ground at any convenient point to support the framework 11. Net 29 is suspended within the framework 11.

The component parts of the invention are preferably formed of high quality, flexible, long lasting, lightweight, weather resistant materials wich allow long term set up. The invention is typically formed of plastic or other suitable material put together in such a manner that the framework 11 forms a particular shape such as a square or a rectangle. However, it is to be understood that the present invention is not limited to a framework designed to form a square or rectangle.

The net 29 is preferably formed of nylon or other suitable material and is placed within the framework 11. Net 29 is supported by lacing 30 drawn about and through the framework 11 in such a way as to hold the assembly together as a one piece unit, yet permitting the assembly to be disjointed enough to permit collapsibility for storage and transporting. As shown at FIG. 1 lacing 30 secures the net 29 to the tubes 13, 15, 17, 19. Cord 30 also passes through apertures 34, 35, 37, 39, 41, 43 and 45 formed in the tubes to detachably connect the tubes to the curved members and "T" connectors.

The invention may be manufactured to suit any size playing area with smaller frameworks, e.g., about 5'×5' goals being especially suited to "backyard" games.

The stakes 31 and 33 may also be attached to the framework by means of stake lines 49 and 51 in such a way as to be drawn within the vertical tubes 15 and 19 for storage. This arrangement permits easy access to stakes and prevents loss of the stakes and also reduces the chance of accidental injury.

As previously mentioned elbows 21 and 23, or other suitable fittings, are used to join the vertical tubes 15 and 19 at the upper ends thereof. "T" members 25 and 27 are used at each of the lower ends of the vertical tubes 15 and 19. Preferably the "T" members are formed to have a smaller diameter opening to receive lower horizontal tube 13, which extends across the bottom of the framework 11. The tube 13 is preferably narrower than tubes 15, 17 and 19 so as to reduce the likelihood that it will interfere with the ball rolling into the net. The member 13 also functions to hold the net 29 off the ground slightly and, therefore, reduces wearing of the bottom of the framework. The lower open portions 26 and 28 of "T" members 25 and 27 also allow the bottom of each of the vertical tubes 15 and 19 to be left open to receive the stakes 31 and 33.

The net 29 is preferably loose enough to form a cavity as the ball is forced into it, yet under sufficient tension to pitch the ball back for individual play/practice.

As previously mentioned the lacing 30 is laced around the framework 11, lacing each section of the framework to an edge of the net 29 as the lacing is wrapped around the tubes 13, 15, 17 and 19. The lacing is preferably begun by feeding the lacing through one of the apertures formed in a tube, e.g. aperture 32, and then wrapped about tube 13, through aperture 34 and out the end of the tube 13. The lacing is drawn through a "T" member 27, into tube 15 and through aperture 35. The lacing then continues up and around the adjacent tube 15. Similarly the lacing continues through aperture 37, through elbow 23 and into, around and out of tube 17. The lacing is then drawn through elbow 21, into, around and out of tube 19. Finally the lacing is drawn through "T" member 25 to complete the loop. The two ends of lacing 30 may be secured together at any convenient point, e.g. meeting in the center of tube 13 and secured together. It is anticipated that a separate lacing or cord may also be drawn through the framework without being wrapped around the framework, thereby further insuring that the tubes and connection members remain together even when in a disassembled form.

As previously mentioned the stake lines 49 and 51 connect to the stakes 31 and 33. In the presently preferred embodiment the stake lines 49 and 51 are drawn through "T" members 25 and 27 and extend partially through tubes 19 and 15, passing through apertures 48 and 50, respectively. By pulling on the stake lines 49 and 51 passing out of apertures 48 and 50, the stakes are drawn into the vertical tubes 19 and 15 for storage. The stake lines 49 and 51 can also be used to wrap the collapsed assembly into a tight compact bundle after it is disassembled.

In use the invention functions as a two way goal. Play is concentrated in the center of the playing field, thus greatly reducing the chance of the ball being kicked or hit into windows or other restricted areas. The invention may be used in a game played by two teams of one or more players on each side, or by one player alone as a practice and training aid.

The invention is preferrably is set up in the center of the playing field. Fenced yards are ideal locations for use. The invention is unfolded and fitted together. The stakes 31 and 33 are dropped out of their storage within the tubes 15 and 19 and pounded into the ground about one half of their length, directly in line with their storage openings. The goal assembly is then placed over the stakes. This completes the fast and easy set up. No boundries are needed in open field play and the fences in fenced playing areas are used as natural boundries.

The invention may be used by two teams standing on opposite sides of the goal and within the width of the vertical tubes 15 and 19. In one game the team winning the coin toss starts by moving around and into the opponent's net side and into the net for a score. The opposing team will attempt to gain possession of the ball before a goal is made and return the ball around and force it into their opponent's side of the goal. Upon scoring, teams again assume starting positions, with the team scored upon having possession of the ball. Play begins when the ball is moved from within the width of the vertical tubes or the opposing side of the goal. Each team must defend one side of the goal. Games may continue, for example, to three or six points, depending upon the age and skill of the players, with best two out of three games being the winner.

The invention may be used in other soccer type games as well, where its size, construction and portability make its usage particularly advantageous. One versus one games are exemplary. One versus one games result in a fast, hard workout. A player either has the ball and is going for a score, or is defending his goal against a source. Because there is no one to pass to in a one versus one game, the players must develop the ability to fake, pass, dribble and open up the defense for a scoring opportunity. One versus one games develop soccer skills, stamina, and spirit by awarding the most opportunities for controlling the ball. From stopping a hard shot on goal to dribbling around to shoot an opponent's goal. Over and over, stabbing, dribbling, faking and shooting, this is the repetitious action that quickly develops the beginning player or maintains the World Class player in the condition necessary for all out, full field soccer play.

The present invention is thus an ideal training tool for coaches due to its portability and versatility. The play is concentrated in the center of the playing area resulting in less injury because top speeds are not generated, as are common in regular soccer where the two goals are placed at each end of the playing field and players are running up and down the field.

The invention may be used as a precise and training aid for teams who normally use regulation soccer fields and goals to develop skills of dribbling, ball control, shielding, faking, shooting, tackling, blocking, stealing the ball and narrowing the angle to the goal.

Although a preferred embodiment of the invention has been herein described, it will be understood that changes of form and specific structures can be effected without departure from the basic principles which underlie the invention. Changes and innovations of this type are therefore deemed to be circumscribed by the spirit and scope of the invention except as the same may be necessarily limited by the appended claims or reasonable equivalents thereof.

What is claimed is:

1. A collapsable two sided soccer goal adapted to receive a soccer ball from either of two opposing sides, said two sided soccer goal comprising:

a plurality of generally tubular members, each said member having a hollow bore extending axially therethrough, said plurality of tubular members being alternately disposable in an assembled configuration wherein said tubular members are rigidly interconnected to form a soccer goal framework having at least two vertical upright members and at least one horizontal crossmember and in a disassembled configuration characterized by a lack of rigid interconnection between said tubular members;

a net engaged to and suspended within the framework, said net being sized and positioned so as to form two directly opposing, vertically disposed, ball-receiving surfaces of substantially identical configuration, each of said ball-receiving surfaces being exposed to receive a ball from substantially any location forward of the respective ball receiving surface; and lacing disposed about the framework and engaging the net to the framework, said lacing further passing through the axial bore of each tubular member so as to maintain all of the tubular members comprising the framework in connected condition when the framework is disassembled.

2. A soccer goal as defined in claim 1 wherein said plurality of tubular members comprises:

two tubular elbows;

two tubular "T" connecting members;

two vertical upright members of tubular form; and two horizontal crossmembers of tubular form;

said crossmembers being connected to said vertical upright members by way of said elbows and "T" connecting members.

3. The goal as recited in claim 1 further comprising a pair of stakes engageable with the framework and cord connected to the stakes and passing through a portion of the framework, said cord being disposed within said framework so as to be useful to draw the stakes within the framework.

4. A soccer goal as defined in claim 2 wherein said net is of a larger size than the framework so as to form a cavity when a soccer ball impacts either of said directly opposing ball-receiving surfaces.

5. A soccer goal as defined in claim 2 whereins said lacing is drawn through the net and through each of said elbows, said "T" connectors, said upright members and said crossmembers so as to cause the elbows, upright members and crossmembers to remain joined when the goal is disassembled.

6. A soccer goal as defined in claim 3 wherein said vertical tubes have apertures formed therein, said stake cord passing therethrough such that said stakes may be inside the side vertical tubes for storage.

7. The two-sided soccer goal of claim 4 wherein said net is further adapted to rebound the impacting soccer ball in a direction generally away from the impacted ball receiving surface, thereby pitching the soccer ball back in the general direction from which it was received.

* * * * *